US006145814A

United States Patent [19]

Perrot

[11] Patent Number: 6,145,814

[45] Date of Patent: Nov. 14, 2000

[54] DEVICE FOR MOUNTING A HANDRAIL ELEMENT ON A POST IN PARTICULAR FOR PRODUCING A STAIRCASE AND A SET PROVIDED THEREFOR

[75] Inventor: Phillipe Perrot, Bad Arolsen, Germany

[73] Assignee: Hewi Heinrich Wilke GmbH, Arolsen, Germany

[21] Appl. No.: 09/070,083

[22] Filed: Apr. 30, 1998

[30] Foreign Application Priority Data

May 2, 1997 [DE] Germany ..... 297 07 890 U

[51] Int. Cl.[7] ..... E04H 17/14

[52] U.S. Cl. ..... 256/67; 256/59; 256/60; 256/DIG. 2

[58] Field of Search ..... 256/59, 60, 65, 256/67, 70, DIG. 2, 68, 69, 26, 27

[56] References Cited

U.S. PATENT DOCUMENTS

| | | | |
|---|---|---|---|
| 3,004,751 | 10/1961 | Woodward | 256/67 |
| 3,018,077 | 1/1962 | Buehler | 248/539 |
| 4,125,249 | 11/1978 | Zen | 256/67 |
| 4,408,749 | 10/1983 | Zieg | 256/67 |
| 4,421,302 | 12/1983 | Grimm . | |
| 4,505,456 | 3/1985 | Zieg | 256/67 |
| 4,886,245 | 12/1989 | Manzo | 256/67 |
| 4,928,930 | 5/1990 | Chung . | |
| 5,437,433 | 8/1995 | Rezek | 256/67 |
| 5,557,893 | 9/1996 | Bowls . | |
| 5,584,469 | 12/1996 | Goodwin | 256/67 X |

FOREIGN PATENT DOCUMENTS

| | | |
|---|---|---|
| 340 120 | 11/1977 | Austria . |
| 0 085 341 A1 | 8/1983 | European Pat. Off. . |
| 0 246 057 A2 | 11/1987 | European Pat. Off. . |
| 0251826 | 1/1988 | European Pat. Off. . |
| 0 279 202 A2 | 8/1988 | European Pat. Off. . |
| 2 193 403 | 2/1974 | France . |
| 2 690 185 | 10/1993 | France . |
| 1 659 865 | 4/1970 | Germany . |
| 37 05 809 A1 | 9/1988 | Germany . |
| 44 42 740 A1 | 6/1995 | Germany . |
| 96/35031 | 11/1996 | WIPO . |

*Primary Examiner*—Lynne H. Browne
*Assistant Examiner*—John R. Cottingham
*Attorney, Agent, or Firm*—Michael J. Striker

[57] ABSTRACT

A device for mounting a handrail element on a post for producing a stair railing and the like has bearing surfaces provided on the handrail elements, spaced in a longitudinal direction, and forming a gap, a rotary part provided on an end on the post and rotatably supported with a cylindrical part of a peripheral surface in a side of the bearing surfaces which faces the handrail element, the rotary part having a portion connected with the post by the gap, the bearing surfaces being formed on a separate structural part which is releasably connectable with the handrail element, the rotary part being formed as a separate structural part which is releasably connectable with the post.

17 Claims, 8 Drawing Sheets

FIG. 11
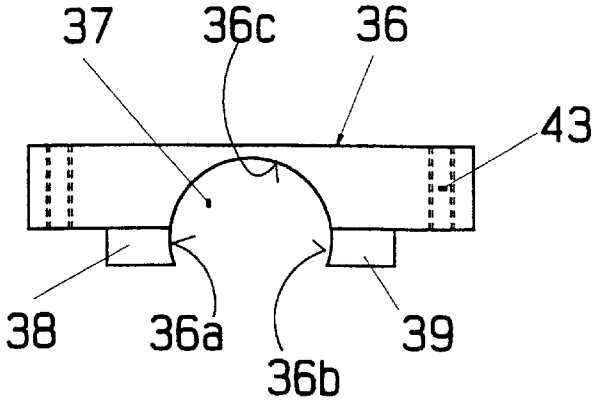
Fig. 13
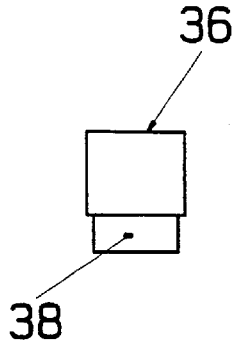
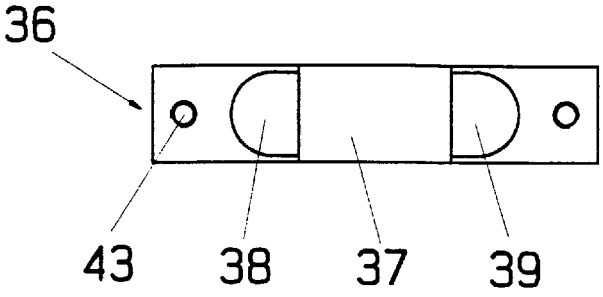
Fig. 12
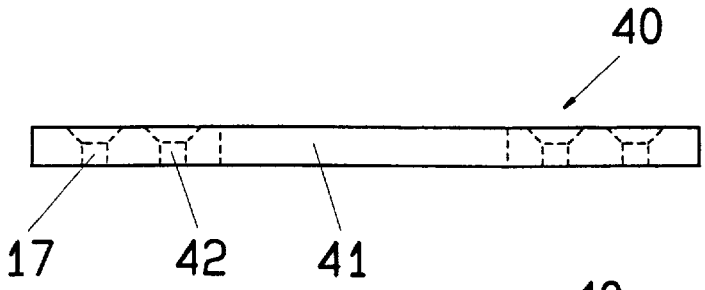
Fig. 14
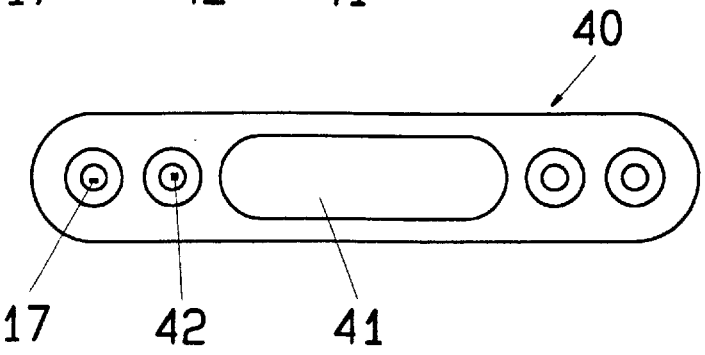
Fig. 15

DEVICE FOR MOUNTING A HANDRAIL ELEMENT ON A POST IN PARTICULAR FOR PRODUCING A STAIRCASE AND A SET PROVIDED THEREFOR

BACKGROUND OF THE INVENTION

The present invention relates to a device for mounting a handrail element on a post for producing a staircase, as well as to a set for such a device.

Mounting of handrails on posts which are erected along a stairs and the like is fixedly performed by means of turning hinges. Such hinges have two hinge parts which are connected with one another by a hinge pin and make possible a simple adaptation of the inclination angle of the handrail elements to the respective stair inclination. Such a device is disclosed for example in the European patent documents EP 0 246 057 A2, EP 0 279 202 A2. The turning hinges are suitable for the utilization of handrails and posts made of metal, since the various hinge parts can be easily mounted by welding or screwing on the associated handrail elements or posts. For the utilization of handrail elements of wood and the like, such devices however are less suitable, in particular when it is desired to support the hinge parts and/or hinge pins so that they are not visible.

European patent document EP 0 085 341 A1 discloses devices which are used specifically for the handrails of wood. In the devices described in this reference, the mounting device includes a turning hinge having a disk of a circular cross-section formed on a post end and a receptacle formed on the handrail element for rotatably supporting the disk. The receptacle has a cross-section corresponding to the shape of the disk and extends in peripheral direction over an angle of for example 100°.

Therefore, at the ends of the peripheral surface an outwardly open gap which is limited by supporting surfaces is formed. The gap has a diameter in a longitudinal direction of the handrail element, which is smaller than the disk diameter. Thereby, the disk can not be pulled out or fall through the gap, and the portion set on the post extends through the gap. The disk is arranged, therefore, except a small outwardly visible portion, inside the handrail element, and thereby a corresponding optical attractive appearance is produced.

However, this known device is not satisfactory in every aspect. First of all the receptacle, because of mounting of the post on the lower side of the handrail element, must be worked always from the side into the handrail element. For this reason it is necessary, after the mounting, to cover the free parts of the receptacle or the visible part of the turning hinge with lateral covers which must be produced from wood or the like when it is necessary to prevent uneveness of the handrail elements at this location. Moreover, the covers, for avoiding visible screw heads, must be connected with the handrail elements by glue or nails, that is complicated and makes difficult dismounting and repairworks. Finally, the production of the handrail elements and posts is expensive.

SUMMARY OF THE INVENTION

Accordingly, it is an object of the present invention to provide a device of the above mentioned general type, which avoids the disadvantages of the prior art.

More particularly, it is an object of present invention to provide a device for mounting a handrail element on a post, which is easy to mount and dismount, which does not have visible mounting elements on a side, and which makes possible a simple manufacture of the handrail elements and posts.

In keeping with these objects and with others which will become apparent hereinafter, one feature of present invention resides, briefly stated, in a device for mounting a handrail element on a post, in which bearing surfaces of the handrail elements are formed on a separate structural part which is releasably connected with the handrail element, while the rotary part at an end of the post is composed of a separate structural part releasably connected with the post.

When the device is designed in accordance with the present invention, it avoids the disadvantages of the prior art and provides for the above mentioned highly advantageous results.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 11 is a front view of a bearing block for the disk of FIGS. 8 and 9 in accordance with the second embodiment of the invention;

FIGS. 12 and 13 each shows a bottom view and a side view of the bearing block of FIG. 11;

FIGS. 14 and 15 are views showing a cover for the bearing block of FIGS. 11 and 12;

DESCRIPTION OF PREFERRED EMBODIMENTS

Figure 1:
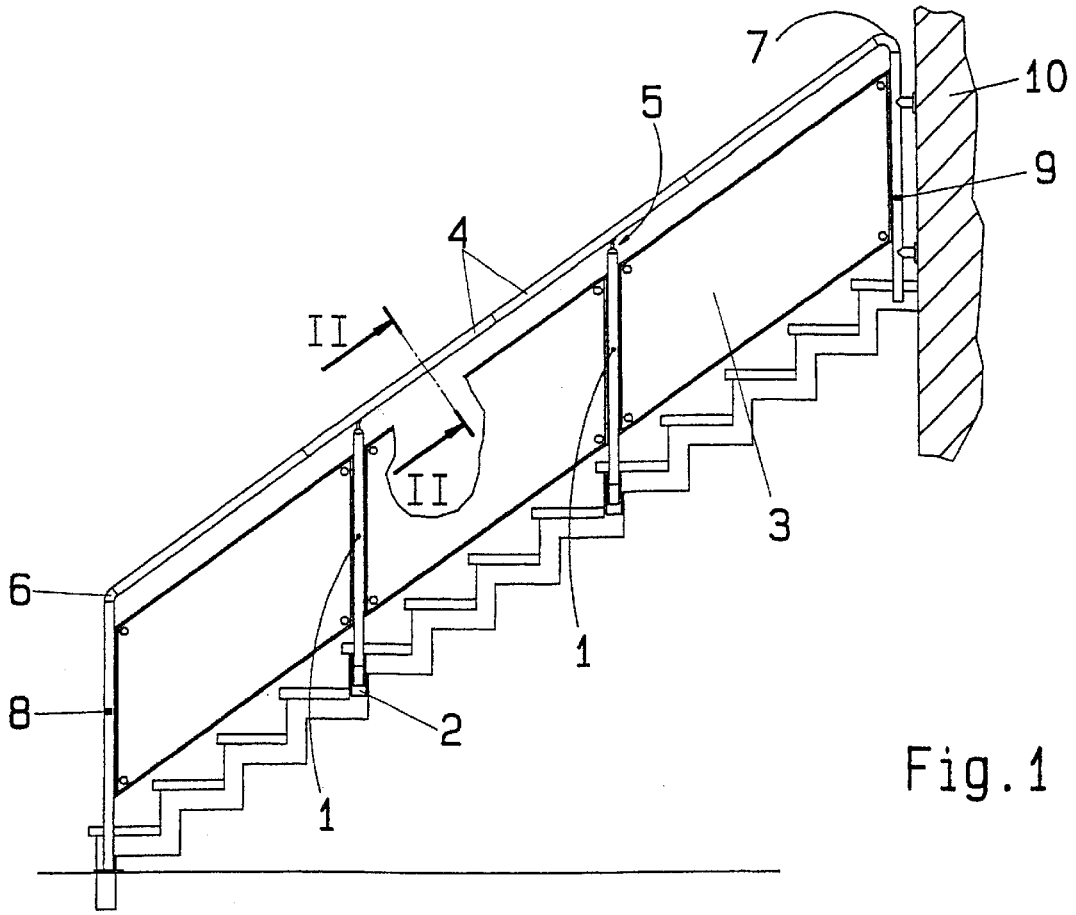
FIG. 1 is a side view of a conventional staircase.

FIG. 1 shows a typical railing which has a plurality of spaced posts 1 arranged as a rule in a vertical position. They are mounted with not shown feet on horizontal foot bottoms or, as shown, on a vertical wall with parallel anchor plates 2, of for example a conventional stair board. The mounting of the anchoring plates 2 on the post 1 can be performed with any means which are not important for the purpose of the invention. Moreover, additional structural elements formed as filler elements 3 can be provided between the neighboring posts 1. They can be formed by plates which extend to the bottom, by a plurality of parallel rods etc, and used to prevent falling through and/or to improve aesthetic appearance. The filler elements 3 are mounted for example by not shown known means on the post 1.

Handrail elements 4 are mounted on the upper elements of the post 1. They have an inclination to a horizontal or to the posts 1, which corresponds to the stairs inclination. They are mounted adjustably on the post 1 by devices 5. The ends of the complete handrail formed from handrail elements 4 are mounted on the end posts 8 and 9 by arcuate elements 6, 7. One of the end posts 9 shown in FIG. 1 is mounted on a wall 10, while the other end post 8 is arranged freely at the beginning of the schematically shown stairs.

The stair railing of this type are generally known and do not have to be explained in detail. Such stair railings are disclosed for example in the European patent DE 0 085 341 A1.

Figure 2:
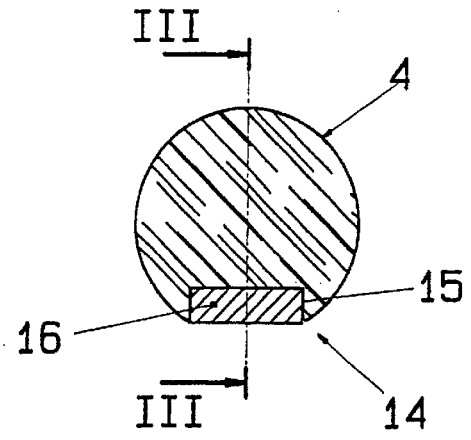
FIG. 2 is a view showing a section taken along the line II—II in FIG. 1 through a handrail element, on an enlarged scale.
Figure 3:
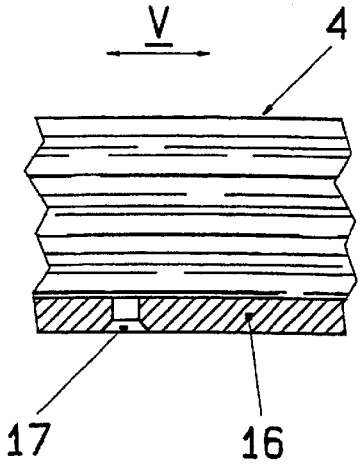
FIG. 3 is a longitudinal section through a part of a handrail element taken along the line III—III of FIG. 2.

In accordance with the invention, the handrail elements 4 have a substantially circular cross-section as shown in FIGS. 2 and 3. At their mounting side 14 they have a groove 15 which extends substantially in a longitudinal direction of the arrow v in FIG. 3 and are open toward the mounting side 14. The grooves are provided for receiving a cover 16 for example a rectangular cross-section. The groove 15 and the cover 16 extend over the whole length of the corresponding handrail 4.

Alternatively, they can extend over a small portion of this length, namely at the location where the handrail element 4 must be connected with the post 1.

If the handrail element 4 is connected with the post 1 at several sides, the handrail element 4 can be provided with corresponding grooves and associated covers 16 at several locations which are spaced from one another in a longitudinal direction. The height of the cover 16 is selected for example so that in the mounted condition the cover 16 is substantially flush with the lower surface of the handrail element 4 and substantially continue its outer contour.

While the handrail element 4 is formed for example as a massive wood or a synthetic plastic rod, the cover 16 is composed preferably of metal, in particular flat steel. Moreover, the covers 16 are provided at suitable distances with openings 17 for receiving of not shown mounting screws for mounting the covers on the handrail elements 4. Since the heads of the mounting screws are located at the downwardly facing mounting side 14, they are not visible from above and therefore do not negatively affect the appearance.

A first embodiment of the inventive device for adjustable mounting of the handrail element 4 on the post 1 is shown in FIGS. 4–10 and is held for the best one up to now. The handrail element 4 has an open hollow space 18 which is provided at the location where it is to be mounted on a post 1, or in other words at the mounting side 14. The hollow space 18 opens toward the post 1. It is produced by milling or the like in the bottom of the groove 15, or in other words from the mounting side 14 and has a substantially parallepiped shape. Furthermore, the cover 16 in the region of the hollow space 18 has the opening 19 shown of FIG. 6 and 7. The opening 19 is limited in the longitudinal direction of the arrow v by oppositely located bearing surfaces 20*a*, 20*b* which extend transversely to the longitudinal direction, or by edge portions. In the shown embodiment the bearing surfaces 20*a*, 20*b* are formed as wedge-shaped surfaces. In the mounted condition shown in FIG. 5 they converge outwardly and form a gap between them. The opening 19 and the bearing surfaces 20*a*, 20*b* form a part of a turning bearing.

Figure 8:
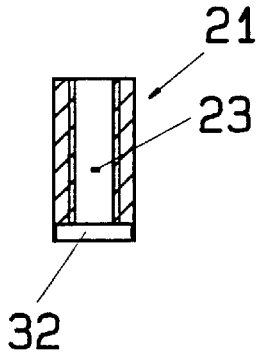
FIG. 8 and 9 are views showing a section through a disk of the device of FIGS. 4 and 5.
Figure 9:
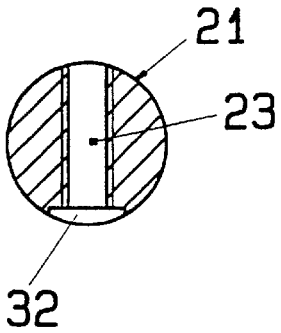
Figure 10:
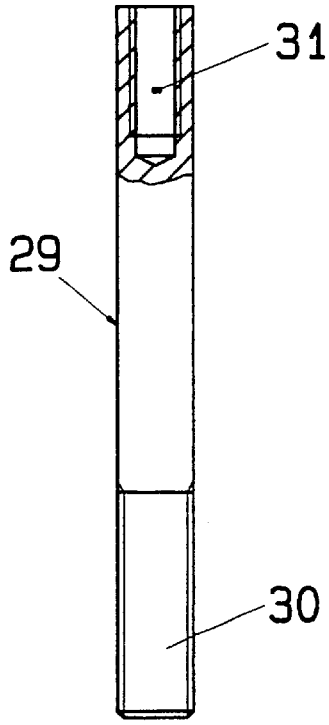
FIG. 10 is a view showing a longitudinal section through a threaded pin of the device of FIGS. 4 and 5.

The second part of the turning bearing is formed by a rotary part formed as a disk 21 shown in FIGS. 8, 9. The disk 21 has a circular cross-section with a diameter which is substantially greater than a smallest distance between the bearing surfaces 20*a*, 20*b*. Its thickness corresponds to the distance between both edge portions 20*c*, 20*d* which limit the opening 19 or is somewhat smaller than this distance. If the disk 21 is inserted in the manner shown in FIG. 5 from above (inwardly) or in other words at the side facing the handrail element 4 and parallel to the arrow v into the opening 19, then it sits with a part of its cylindrical peripheral surface on the bearing surface 20*a*, 20*b*. A portion 21*a* whose periphery is smaller than the half periphery of the disk 21 extends outwardly from the opening 19. The disk 21 is provided at this portion 21*a* with a radially projecting pin 22. It fixedly connects the disk 21 with the post 1.

In this embodiment, the pin 22 is formed as a threaded pin screwed in a threaded opening 23 extending diametrically through disk 21 shown in FIGS. 8, 9. The pin 22 is longer than the threaded opening 23 and is provided on the outwardly extending end with a means 24 for setting a tool, for example a slot for a screwdriver blade.

Figure 4:
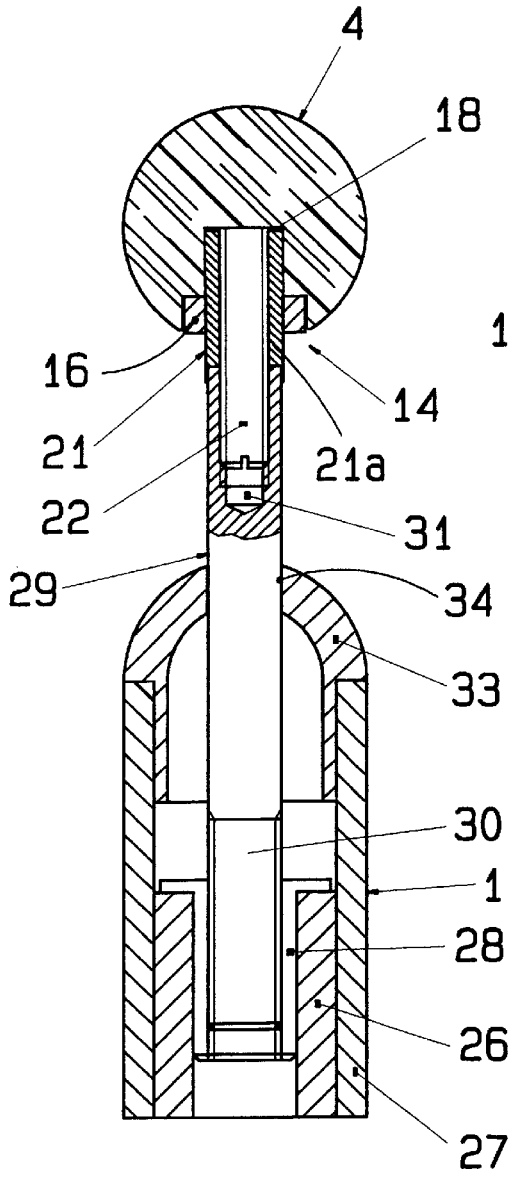
FIGS. 4 and 5 are sections substantially corresponding to the views of FIG. 2 and 3 but showing an inventive device for adjustable mounting of the handrail element on a post, wherein the handrail element of FIG. 4 is arranged perpendicular and the handrail element in FIG. 5 is arranged inclined to the post.
Figure 5:
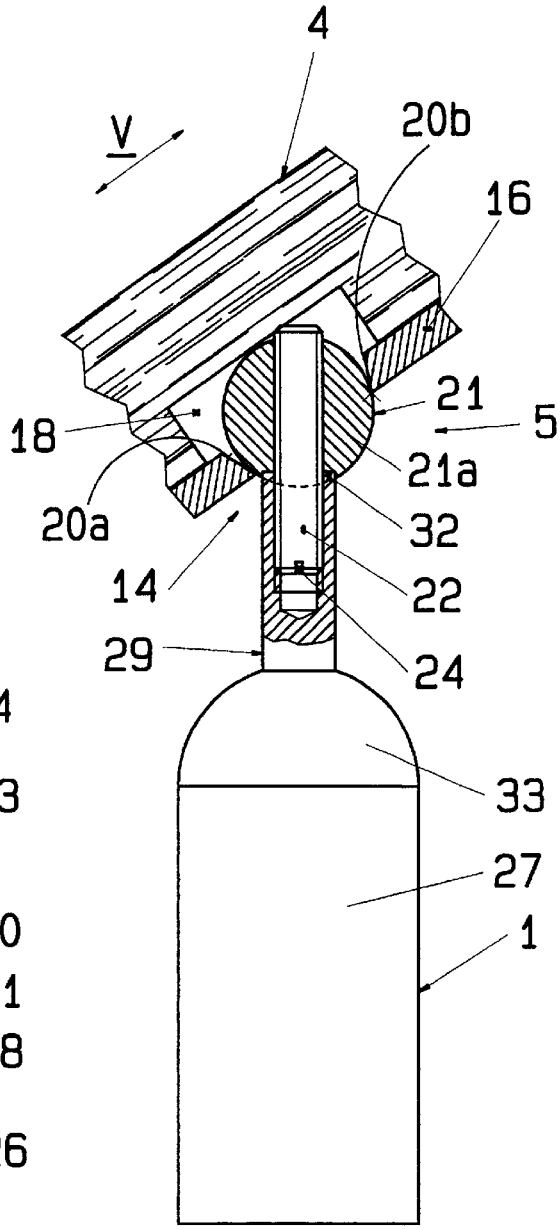
Figure 6:
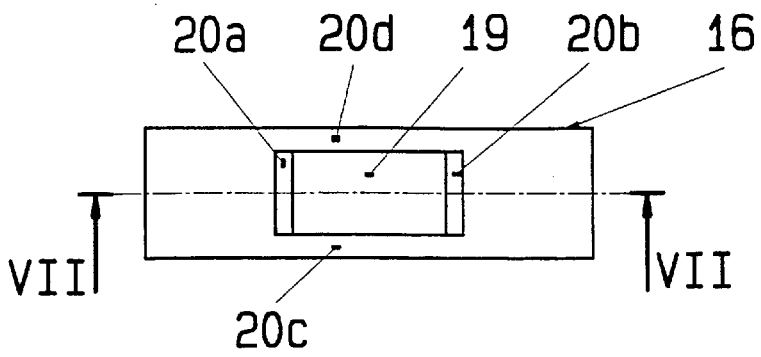
FIG. 6 is a plan view of a cover the device of FIGS. 4 and 5 in the region of a mounting location.
Figure 7:
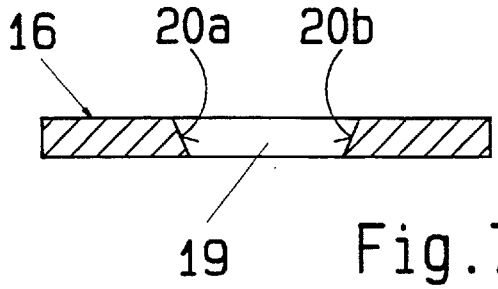
FIG. 7 is a longitudinal section through the cover taken along the line VII—VII in FIG. 6.

For mounting the handrail element 4 on the post 1, the disk 21 is inserted first in the manner shown in FIGS. 4 and 5 into the hollow space 18 so that the pin 22 extends outwardly at the mounting side 14. Then the cover 16 is inserted in the groove 15 so that the pin 22 and the portion 21*a* of the disk 21 extend in the opening 19 and then is mounted on the handrail element 4 by mounting screws extending through the openings 17 shown in FIG. 3. The distance between the bottom of the hollow space 18 and the inner surface of the cover 16 is selected in correspondence with the disk diameter so that with a mounted cover 16, the disk abuts with its peripheral surface on the one hand against the bearing surfaces 20*a*, 20*b* and on the other hand against the bottom of the hollow space 18 and thereby is supported clatter-free in the hollow space 18. For producing an easily accessible bearing, a small play however can be provided.

The disk 21 can be now reciprocatingly turned arbitrarily within an angular region which is determined by the abutment of the pin 22 on the lower edges of the supporting surfaces 20*a*, 20*b*. Thereby the pin axis can be oriented at the same angle relative to the direction of the arrow v, which is true for the axis of the post 1. Subsequently, the free end of the pin 22 is fixed in a corresponding receptacle of the post 1 and then the post 1 is mounted in a conventional manner on a stair board, on the foot bottom and the like. Some final adjustments of the angular arrangement can be performed by turning of the handrail element 4 relative to the disk 21. Alternatively, it is however possible first to produce the desired angular position of the pin 22, and then to turn it by a tool and the means 24 into the disk 21 so deep that it projects from the diametrically opposite side and is pressed with the inwardly located end into the bottom of the hollow space 18. Thereby the position of the disk 21 is fixed in looseless and clatter-free manner.

A sleeve-shaped receptacle with a corresponding inner thread is provided on the upper end of the post shown in FIGS. 4 and 5, for mounting the pin 22 on the post. In an especially advantageous embodiment shown in FIGS. 4 and 10, the post 1 includes a steel pipe 26 and a synthetic plastic pipe 27 arranged on the steel pipe and extending over its upper end. A sleeve 28 provided with an inner thread is mounted in the upper end of the steel pipe 26 for example by pressing into it. Furthermore, as can be seen specifically from FIG. 10, a substantially cylindrical threaded pin 29 is provided. It has at one end an outer threaded portion 30 corresponding to the sleeve 28 and at another end an inner threaded portion 31 which correspond to the outer thread of the pin 22. During mounting the threaded pin 29 is screwed in correspondence with FIG 4 first for example with the outer threaded portion 30 into the sleeve 28, and then by turning of the post 1 with its inner threaded portion 31 onto the preferably fixedly arranged pin 22, until it abuts against the disk 21 or the bottom of a ring-shaped blind-hole receptacle 32 which is formed in the outer surface of the disk 21 and surrounds the threaded opening 23. Therefore, no threaded parts or abutment joints are visible. Moreover, the upper end of the synthetic plastic tube 27 is preferably covered with a pressed or clipped cap 33. A threaded pin 29 extends through the cap and its passage 34 having a corresponding cross-section. The threaded pin 29 is used to provide a height adjustment of the handrail element 4 within a broad range, since it is turned both into the sleeve 28 and on the pin 22 and thereby can be axially displaced relative to the post 1 the handrail element 4.

As can be seen specifically from FIG. 5, the turning region of the disk 21 increases with the increase of the depth of the center point or the rotary axis of the disk 21 in the opening 19 of the cover 16. If the opening 19 is made for example with a mill, the bearing surfaces 20*a*, 20*b* can have a cylindrical form which corresponds to the disk shape and is suitable for a surface contact. The disk axis, due to the abutment of the axis of the mill head against the cover 16, can however approach maximum the inner surface. If the bearing surfaces 20*a*, 20*b* have a conical shape shown in FIG. 5 then the disk 21 can abut against them only with a linear contact but its axis is then located under the inner surface of the cover 16, so that a turning angle of +/−40° can be achieved without any problems. Since the bearing surfaces 20*a*, 20*b* serve only for producing the desired angular position, a linear contact is sufficient.

In a second embodiment of the invention shown in FIGS. 11–16 in which the same parts are identified with the same reference numerals as in FIGS. 1–10 the disk 21 is rotatably supported not on the cover 16, but instead in a substantially parallelepiped-shaped bearing block 36. It has a receiving opening 37 suitable for receiving the disk 21 and a thickness substantially corresponding to the disk 21. The receiving opening 37 has a cross-sectional shape corresponding to the peripheral surface of the disk 21, but extends only over a peripheral portion which is insignificantly greaterthan 180°. The receiving opening 27 is open toward the mounting side 14 only by a gap which is limited by bearing surfaces 36*a*, 36*b*. The bearing surfaces 36*a*, 36*b* are spaced from one another in a longitudinal direction in accordance with the arrow v in FIG. 16 and located opposite to one another. They correspond to the bearing surfaces 20*a*, 20*b* of FIGS. 5–7 and prevent withdrawal or falling out of the disk 21. In this case, the bearing surfaces 36*a*, 36*b* extend however along an imaginary cylindrical surface. Moreover, they extend through a surface 36*c* extending also along the imaginary cylindrical surface, over more than 180°, to a closed surface narrowly surrounding the disk 21.

As shown in FIGS. 11–13, the bearing block 36 in the lower outwardly facing region has two projections 38 and 39 which adjoin a receiving opening 37. They have a substantially semi-circular cross-section. Moreover a cover 40 which corresponds to the cover 16 is provided in the regions of connection of the handrail element 4 with the post 1, with a recess 41. The recess has substantially a size which corresponds to the imaginary peripheral surface located around the projection 38, 39 and the intermediate gap of the receiving opening 27. It is therefore possible to extend the projections 38, 39 into the opening 41 in a form-locking manner and, if a corresponding shaping is provided, to hold the bearing block 38 non-displaceably and non-rotatably relative to the cover 40 and in such a manner that a gap between the bearing surfaces 36*a*, 36*b* remains free. Moreover, the cover 40 preferably has screw openings 42, so that the not shown mounting screws can be screwed into corresponding threaded openings 43 of the bearing block 36 for fixed connection of the bearing block with the cover 40 when being located with its projections 38, 39 in the opening 41.

Figure 16:
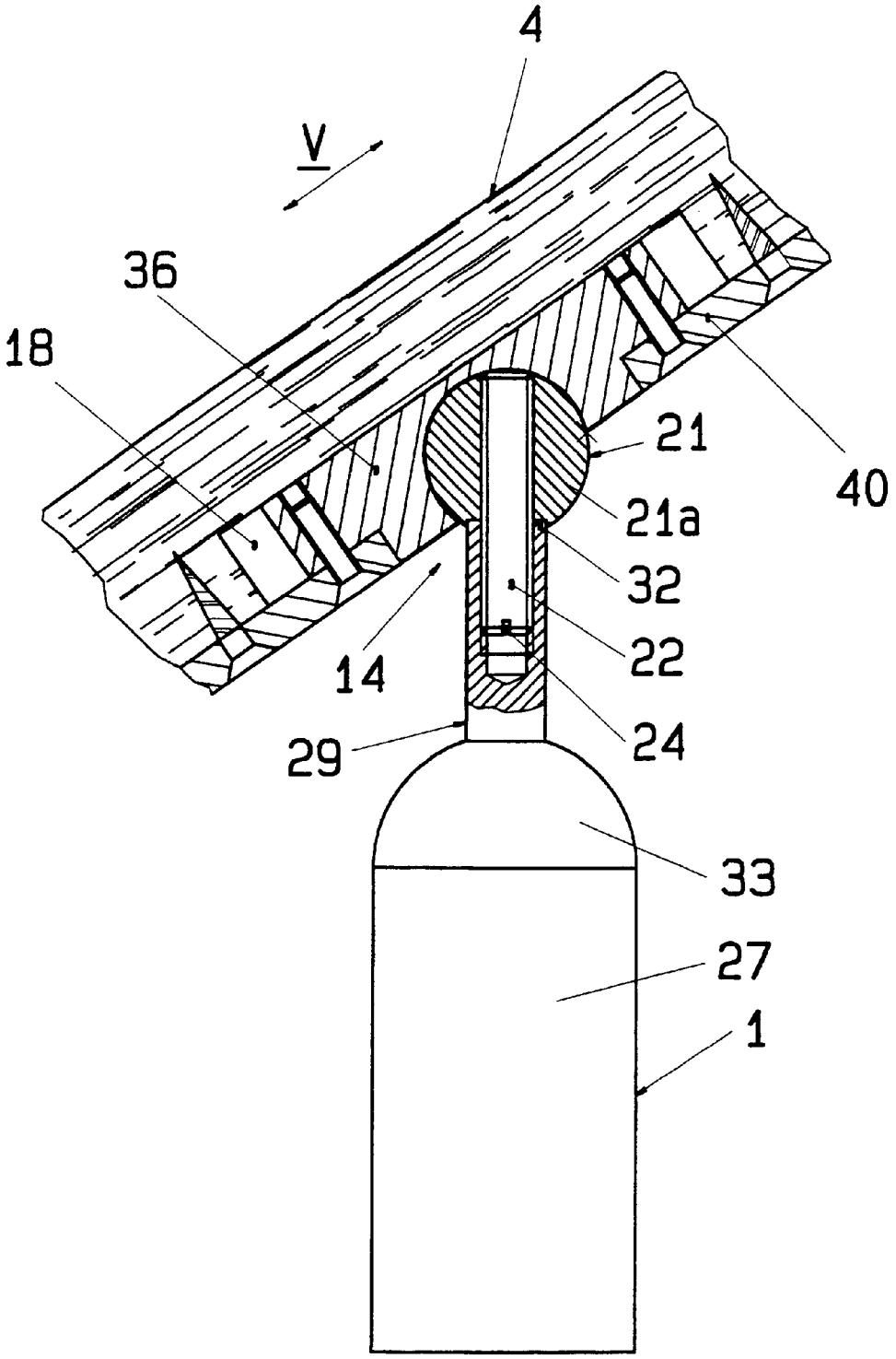
FIG. 16 is a section substantially corresponding to FIG. 5, extending through a bearing block of FIGS. 11–13 and the cover of FIGS. 14–15, of the inventive arrangement.

The connection of a handrail element 4 with a post 1 is performed with the use of the device which is shown in FIGS. 11–16 analogously to the embodiment of FIGS. 1–10. The difference is that before the mounting of the cover 40, the disk 21 including the bearing block 36 receiving it is inserted in the hollow space 18 of the hand rail 4 as shown in FIG. 16. The insertion of the disk 21 into the bearing block 36 is performed in its axial direction from a side of the receiving opening 37.

Figure 17:
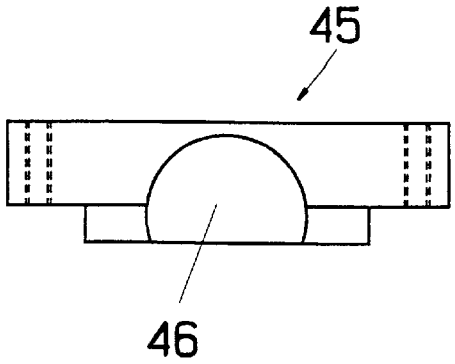
FIGS. 17 and 18 are views corresponding to FIGS. 11 and 12 and showing a further embodiment of the inventive bearing block.
Figure 18:
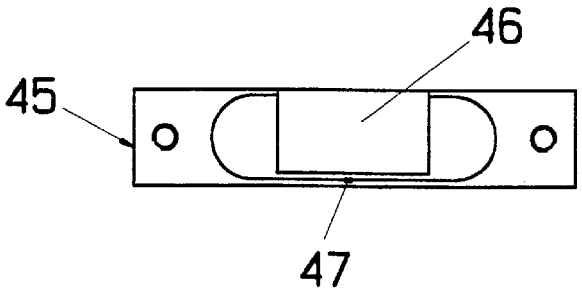

FIG. 17 and 18 show a bearing block 45 with a receiving opening 46 for the disk 21. The opening 46 is formed in correspondence with FIGS. 11–12 and has at one side end a wall 47. In this case the disk 21 can be inserted only from one side into the receiving opening 46 which preferably has a width corresponding to the thickness of the disk 21.

Figure 19:
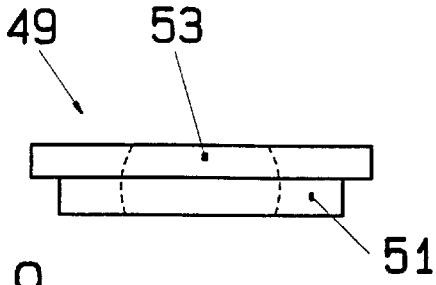
FIGS. 19 and 20 are a front view and plan view of a third embodiment of the inventive bearing block.
Figure 21:
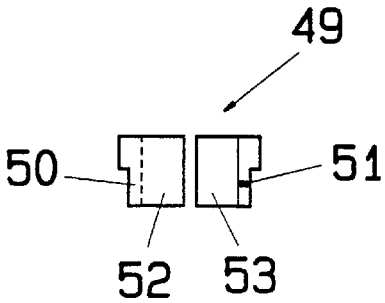
FIG. 21 is a side view of the bearing block of FIGS. 19 and 20 when looked at FIG. 1 from the left side view.
Figure 20:
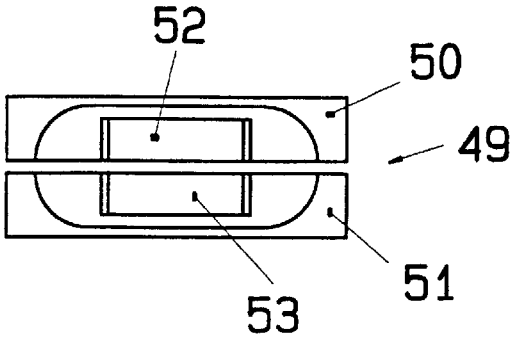

In the embodiment shown in FIGS. 19–21 a two-part bearing block 49 is provided. It is composed of two semi-shells 50 and 51 formed analogously to FIGS. 17 and 18 and each having a receiving opening 52 or 53 corresponding to the receiving opening 46. The width of each opening 52, 53 corresponds preferably substantially the half thickness of the disk 21. The both semi-shells 50–51 face one another with the open sides of the receiving openings 52, 53 so as to receive the disk 21 therebetween. The bearing surface is formed in this case by a flat portion of both semi-shells 50, 51. This provides for advantage that the bearing block 49 can be assembled in a simple manner from flat steel portions. The mounting of the both semi-shells 50, 51 in the hollow space 18 of the handrail element 4 is performed either by forming the cross-section of the hollow space matching, or by connecting each semi-shell 50, 51 fixedly with a cover analogously to FIGS. 11–16. Also, other two-or multi-part constructions of the bearing block are possible.

Figure 22:
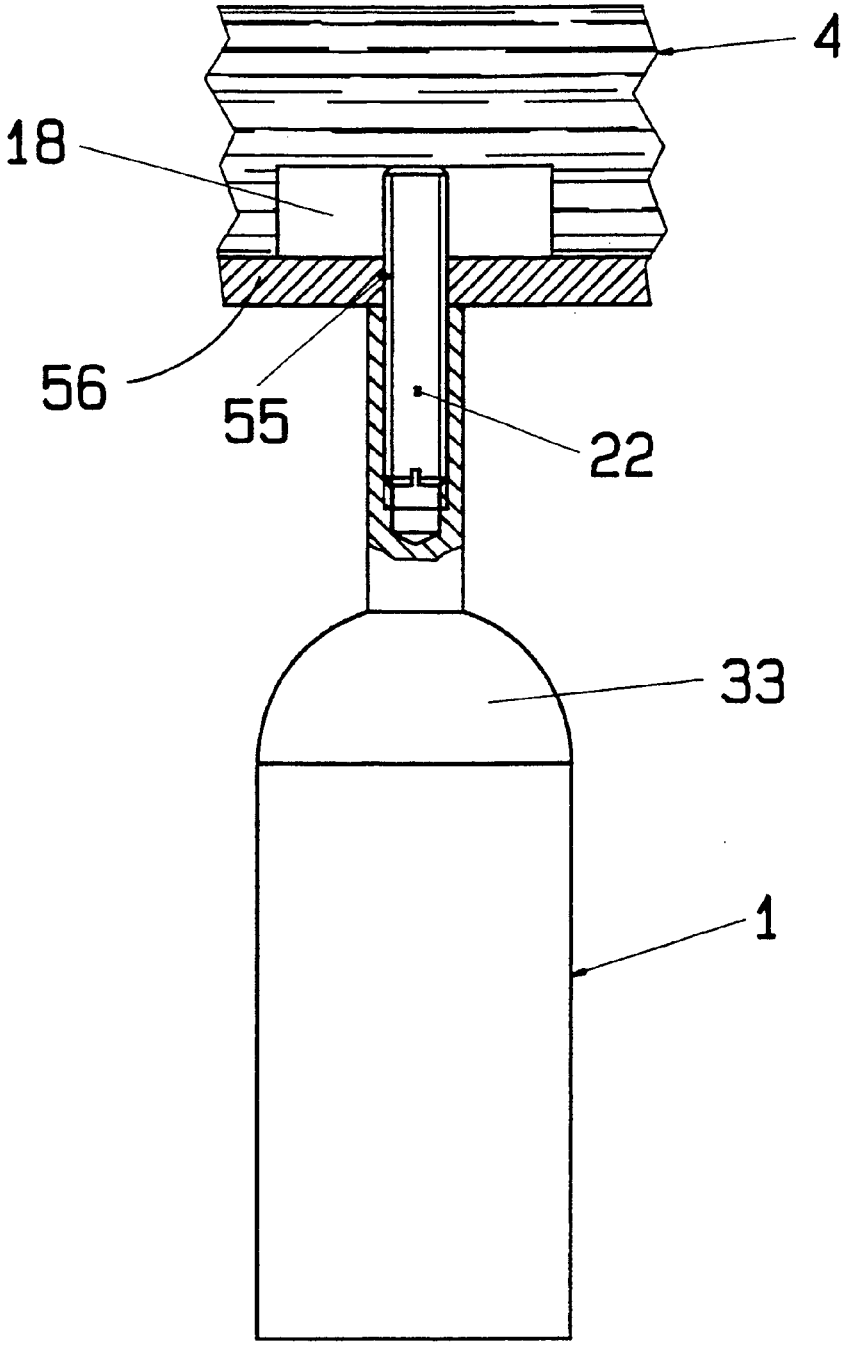
FIG. 22 is a section corresponding to FIG. 5 but related to a further embodiment of the inventive device for mounting of the handrail on posts.

FIG. 22 shows a variant for mounting of the handrail element 4 on a post 1 with a horizontal arrangement. Instead of the disk 21, here the pin 22 formed as a threaded pin is screwed simply into a threaded opening 55 provided in a cover 56 which corresponds to the cover 16 and at a location where a hollow space 18 is provided. The pin 22 can be inserted so deep until it abuts against the bottom of the hollow space 18, when this appears advantageous for increasing the stability. The pure utilization of a second cover with the same parts can therefore convert the mounting device described in FIGS. 1–21 into a mounting device in which only the height position of the handrail 4 is adjustable, but not its angular position.

Figure 23:
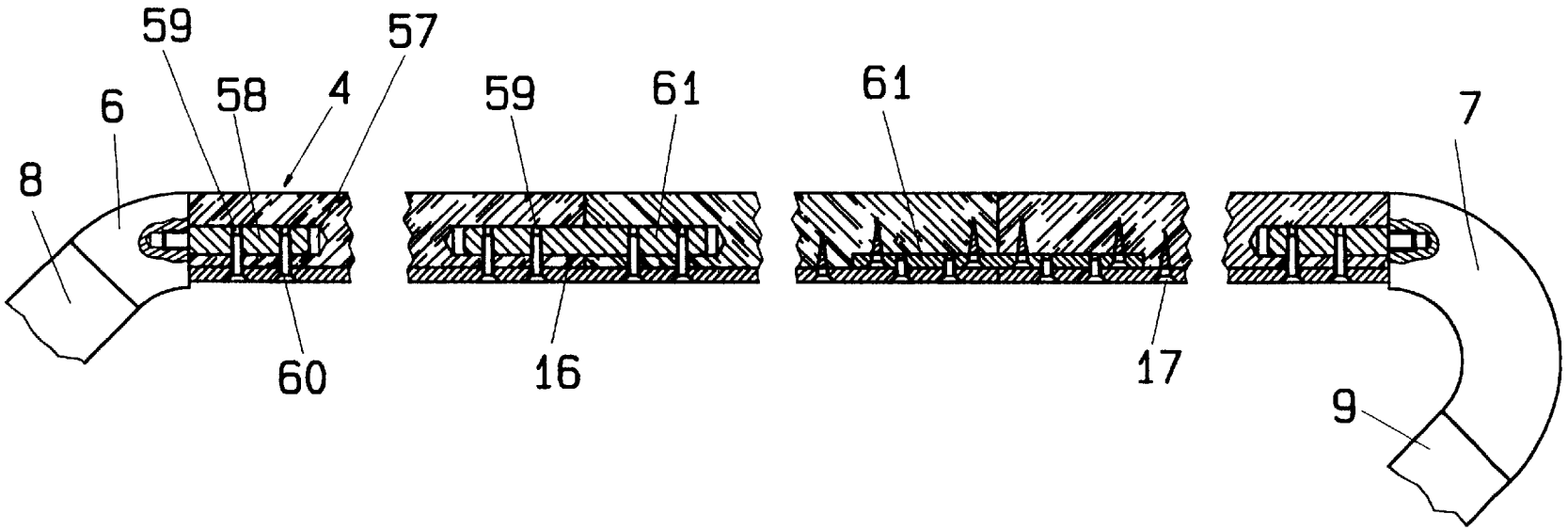
FIG. 23 is a cross section view of the hand rail connection.

In accordance with a preferable embodiment of the invention the covers 16, 40, 56 each extend over the whole length of the handrail 4 as shown for the cover 16 in FIG. 23. For this case the arcuate elements 6, 7 are preferably connected in a similar way by means of steel parts with the posts 1, which is also true for the above described connection between the covers 16, 40, 56 and the posts 1, since both the disks 21 and the pins 22 as well as the sleeves 28 and the threaded pins 29 are preferably composed of steel. Finally, the connection of the handrail elements with the arcuate elements 6, 7 is performed in accordance with FIG. 23. The handrail elements 4 are provided at their ends with end-side receiving openings 57 formed as blind holes. Tongues, pins or and similar connecting elements 58 composed of metal, in particular steel, are inserted in the receiving openings. The connecting elements 58 are fixedly connected with the corresponding metal parts of the arcuate elements 6, 7 and provided with transversely extending threaded openings 59. Moreover, the covers 16 at the locations where the connecting elements 58 are located, are provided with screw holes for receiving the mounting screws 60. In the mounting condition they are oriented toward transverse openings which are formed in the handrail element 4 and open in the receiving opening 57. It is therefore possible, after the complete mounting of a railing, to screw the screws 60 through the covers 16 into the openings 59 of the connecting elements 58. A similar construction can be provided at the joints between two handrail elements 4 in which case connecting elements 61 projecting the joints are provided. Thereby in relatively simple manner it is possible to provide a railing, despite the use of the handrail elements 4 composed of wood, etc, with a throughgoing steel skeleton. This skeleton is advantageous not only from structural reasons, but also in the event of fire it guarantees that the supporting functions of the railing will be maintained.

The invention is not limited to the inventive embodiments, which can change in many ways. For example, FIG. 5 shows that the disk 21 must not be formed completely circular, but instead circular only in the regions which cooperate in the predetermined turning region with the bearing surfaces 20*a*, 20*b* or 36*a*, 36*b*, while the remaining part of the peripheral surface can be shaped differently. Furthermore, the described arrangement is not limited to the preferable combination of wood and steel or synthetic plastic, but instead can be used with other material combinations as well. Advantageously in all cases, first of all the disks 21 form a separate structural part which is not produced of one piece integrally with the post 1 or molded on it and thereby can be manufactured in a simple manner. The same is true for the bearing surfaces which are formed either on the cover or on a separate bearing block but not on the handrail element. Thereby it is possible on the one hand to produce or mount all parts of the mounting device at the lower mounting side, so that the handrail has no lateral discontinuity. On the other hand, the positions of the disk 21 and the bearing surfaces are freely selectable in or on the handrail elements 4. Advantageous is also that the handrail elements 4 do not need any laterally mounted covers and the like. Furthermore, the above described mounting device instead of the stair railing, can be used in handrails or railings on inclinedly arranged foot bottoms or the like, or used in handrail elements which are mounted for example directly on a wall or the like, or in other words at a side of a stairs where it is limited not by a railing but instead by a wall. In this case, the posts 1, instead of being linear structural elements shown in FIGS. 1–13, can be formed for example as angled posts, particularly with an angle of 90°, as in conventional handrail supports, which in their upper regions are formed analogously to FIGS. 4, 5, 16. It is further possible to provide the corresponding mounting devices also on the lower ends of the posts 1, when the corresponding railing or the like must be mounted on the lower post ends by a construction similar to the handrail.

Moreover, the present invention also deals with an assembly set which contains all elements provided for selective horizontal and/or inclined arrangement of the handrail elements (FIGS. 4, 5, 16), and also for an exclusively horizontal arrangement of the handrail elements of (FIG. 22). Finally, the various features of the present invention can be used in combinations which are not shown and described here.

It will be understood that each of the elements described above, or two or more together, may also find a useful application in other types of constructions differing from the types described above.

While the invention has been illustrated and described as embodied in device for mounting a handrail element on a post in particular for producing a staircase, and a set provided therefor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A combination of at least one handrail element, at least one post and a mounting device for pivotally mounting said handrail element to said post, said handrail having a mounting surface and a hollow space being open to said mounting surface, said post having an end and said mounting device comprises: a separate structural part for being releasably mounted to said mounting surface, said structural part having a longitudinal direction and being provided with bearing surfaces which are spaced from each other in said longitudinal direction forming a gap therebetween; a separate rotary part having a cylindrical peripheral portion for being rotatably supported on said bearing surface and for being at least partially received within said hollow space when said structural part is mounted to said handrail element, and a projecting portion for projecting said gap when said cylindrical portion is supported on said bearing surfaces; and means for releasably connecting said projecting portion with said end of said post.

2. A combination as defined in claim 1; and further comprising a cover which is arranged at least in a region of said hollow space and is releasably mountable to said mounting surface of said handrail element, said cover having an opening which is limited by edge portions to said cover being spaced in a longitudinal direction, said edge portions forming said bearing surfaces.

3. A combination as defined in claim 2, wherein said bearing surfaces are formed as wedge-surfaces.

4. A combination as defined in claim 1, wherein said structural part provided with said bearing surfaces is formed as a bearing block which is insertable in said hollow space.

5. A combination as defined in claim 4; and further comprising a cover arranged at least in a region of said hollow space and mountable to said mounting surface of said handrail element, said cover having an opening leaving a free space between said bearing surfaces.

6. A combination as defined in claim 4, wherein said bearing block is composed of several elements.

7. A combination as defined in claim 6, wherein said bearing block is composed of two facing semi-shells having flat portions which together form said bearing surfaces.

8. A combination as defined in claim 2, wherein a groove is provided within said mounting surface of the handrail element and parallel to a longitudinal axis thereof, said cover being arranged in said groove.

9. A device as defined in claim 8, wherein said groove and said cover extend over a whole length of the handrail element.

10. A device as defined in claim 1; and further comprising means forming a receiving opening in the handrail element at least on one end for connecting with a further handrail element or an arcuate element.

11. A combination as defined in claim 10; and further comprising means forming a transverse opening provided on one end of the handrail element and opening into said receiving opening.

12. A combination as defined in claim 1, wherein said projecting portion of said rotary part is provided with a radially extending pin for being mounted to said end of the post.

13. A combination as defined in claim 12, wherein said pin is formed as a threaded pin, said disk having a radially extending threaded opening for releasably receiving said threaded pin.

14. A combination as defined in claim 12; and further comprising a receptacle provided in said end of the post for receiving said pin.

15. A combination as defined in claim 14, wherein said pin is formed as a threaded pin and wherein said receptable is formed as a sleeve with an inner thread.

16. A combination as defined in claim 14, wherein said receptacle is a sleeve having an inner threaded portion, said pin is a pin having an outer threaded portion and threaded pin member is provided with an outer threaded portion screwable into threaded portion of said sleeve and another end provided with an inner threaded portion for receiving said threaded pin.

17. A combination defined in claim 1; and further comprising a cover for being mounted to said mounting surface of said handrail element and provided with a threaded opening for being located in the region of said hollow space for receiving a threaded pin.

* * * * *